United States Patent [19]

Witt, Jr.

[11] 4,339,062

[45] Jul. 13, 1982

[54] CONVENIENCE FLASK

[75] Inventor: Frank H. Witt, Jr., Trumbull, Conn.

[73] Assignees: Rosalie S. Levine, Trumbull; Mildred S. Bisacca, Fairfield; GRRN Company, Easton, all of Conn. ; a part interest to each

[21] Appl. No.: 204,908

[22] Filed: Nov. 7, 1980

[51] Int. Cl.[3] ..... B65D 25/22

[52] U.S. Cl. ..... 224/148; D7/77; D9/307; 215/13 R

[58] Field of Search ..... 224/148, 202, 257; 215/13 R, 12 A; 206/217; D9/307; D7/77

[56] References Cited

U.S. PATENT DOCUMENTS 3,882,628 5/1979 Stouder ..... 43/55

4,164,284 8/1979 Witt et al. ..... 206/217

*Primary Examiner*—Donald F. Norton

*Attorney, Agent, or Firm*—Cushman, Darby & Cushman

[57] ABSTRACT

A flask or like device is provided which can be hung around the user's neck in a convenient manner. A bottom portion of the flask encloses a volume for containing liquid and has a neck with a screw-on cap extending upwardly from it. A top portion of the flask covers the neck and cap, and can snap into place with the bottom. A cord is dimensioned, and attached to the flask bottom, so that it can hang around a user's neck while supporting the bottom portion resting on the user's chest area, the cord being attached at the free ends thereof to the flask bottom adjacent the neck, and extending through one or more openings formed in the top.

11 Claims, 4 Drawing Figures

CONVENIENCE FLASK

BACKGROUND AND SUMMARY OF THE INVENTION

In U.S. Pat. No. 4,164,284 a convenient liquid container is disclosed. The container is adapted to be hung about the user's neck, and is readily transportable and utilizable, being particularly adapted for use at sporting events and the like. According to the present invention, a liquid container is provided having the advantages of the device in U.S. Pat. No. 4,164,284 and also being more readily adaptable to a wide variety of different sizes and configurations.

The flask according to the present invention has the cord for supporting it around the user's neck dimensioned and attached in such a manner that the points of attachment cannot be seen from the exterior of the flask, and when the cord is draped around the user's neck the flask extends down to about the chest area of the user. A separable top portion of the flask is slidable with respect to the cord, the cord maintaining a separable top portion with respect to the bottom portion so that it will not be misplaced, and a separate capped neck being provided for the bottom portion, the bottom portion enclosing the volume of liquid to be contained by the container.

More particularly, the flask according to the present invention comprises a bottom portion defining and enclosing a volume for containing liquid, a neck extending outwardly from the bottom portion and defining an open tubular passageway in liquid communication with the liquid-containing volume of the bottom portion, and removable cap means for covering the neck to prevent passage of liquids through the tubular passage. A top portion is also provided as well as surface means formed on the top and bottom portions for releasably holding the top portion to the bottom portion so that the neck and cap means are covered by the top portion and not visible from the exterior of the flask with the top portion in a position held by the bottom portion, and are visible from the exterior of the flask when the top portion is in a detached position, not held by the bottom portion. A cord, strap, or the like is provided as well as means for attaching the cord to the bottom portion of the flask adjacent the neck so that the areas of attachment of the cord to the bottom portion are not visible from the exterior of the flask when the top portion is in the position held by the bottom portion. Further, means are provided defining at least one opening in the top portion providing passage of the cord from the bottom portion through the top portion so that the top portion is movable with respect to the bottom portion and slides with respect to the cord, with the cord maintained in association with at least one opening receiving the cord. The cord is dimensioned and the cord attaching are constructed so that the cord can hang around an adult human being's neck and support the bottom portion resting on the human's chest area.

The attaching means for the cord may comprise a pair of attaching structures, one on either side of the neck, and either one or two holes may be provided in the flask top portion through which the cord extends. The cap means may comprise a cap having internal threads corresponding to external threads of the neck, and the neck may be integral with an inner container surrounded by an outer container, which together comprise the bottom portion. Heat insulating means may be provided between the inner and outer containers, and the attaching means may provide means defining an opening extending through the outer container receiving the cord therein and means provided between the inner and outer containers for preventing passage of a cord portion between the inner and outer containers through the opening in the outer container.

The flask may further comprise an indentation formed in the exterior surface of the bottom portion adjacent the surface means formed on the bottom portion so that an individual using the flask may insert his/her finger underneath the top portion to effect detachment of the top portion from the bottom portion. Preferably the top and bottom portions together comprise the general exterior configuration of a ball used in sporting events, such as a soccer ball, basketball, baseball, tennis ball, football, etc. A wide variety of other configurations are also possible, however, including other configurations having a sports theme. The construction of the flask according to the present invention allows structures having a very accurate reproduction of various ball configurations (e.g., soccer ball and basketball) without the necessity for accessory exterior lines of demarcation which may affect the appearance of the structure.

It is the primary object of the present invention to provide a readily utilizable flask or similar article, having a wide variety of configurations. This and other objects of the invention will become clear from an inspection of the detailed description of the invention and from the appended claims.

DETAILED DESCRIPTION OF THE DRAWINGS

Figure 1:
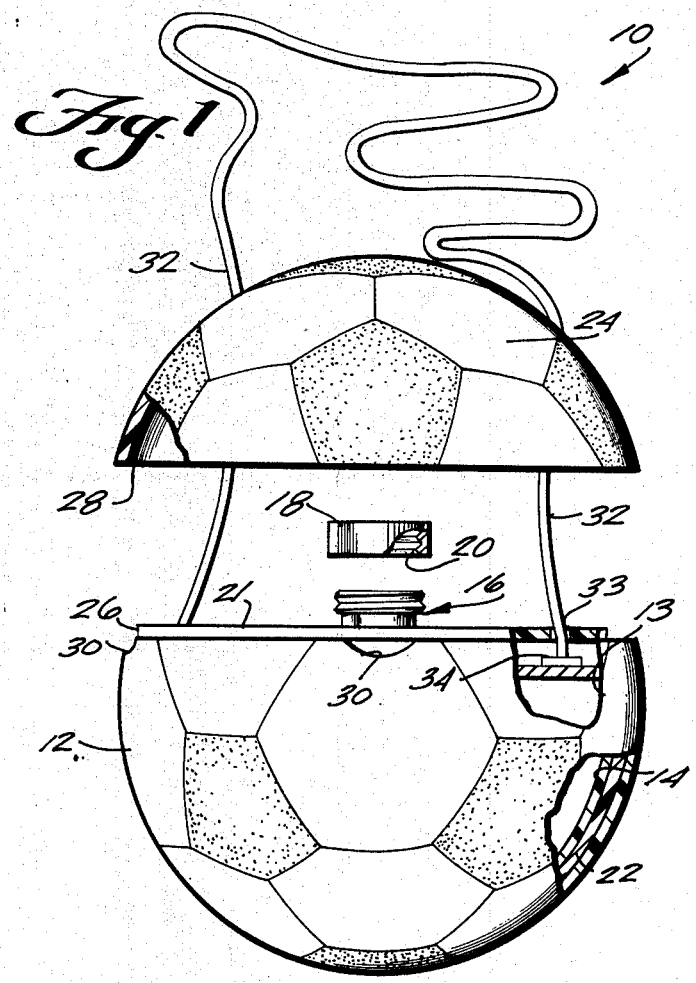
FIG. 1 is a side exploded view, with portions cut away to illustrate various components, of an exemplary flask according to the present invention.
Figure 2:
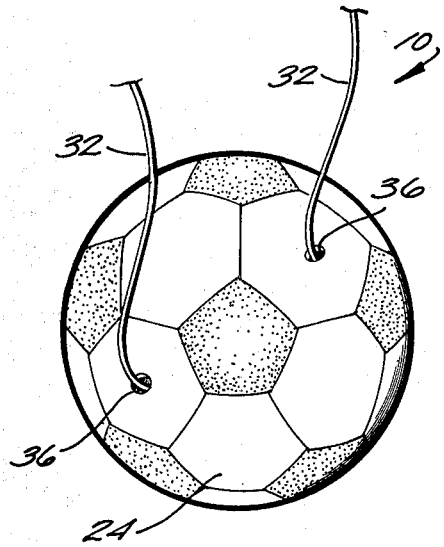
FIG. 2 is a top plan view of the flask of FIG. 1.

An exemplary flask according to the present invention is shown generally at 10 in FIGS. 1 and 2. The flask includes a bottom portion 12 which defines and encloses a volume for containing a liquid, particularly a hot, cold, or room temperature beverage. In the embodiment illustrated in FIG. 1, the bottom portion 12 includes an outer container 13 and an inner container 14 received within the outer container 13. A neck 16 extends outwardly from the bottom portion 12 and defines an open tubular passageway in liquid communication with the liquid containing volume of the bottom portion. In particular, the neck 16 can be integral with and in liquid communication with the inner container 14.

A removable cap means, such as cap 18, is provided for covering the neck 16 to prevent passage of liquid through the tubular passageway. In the exemplary embodiment illustrated in FIG. 1, the neck 16 has external screw threads formed thereon which cooperate with interior screw threads 20 formed in cap 18. The neck 16 extends outwardly from the bottom 12 a sufficient distance to facilitate ready pouring of liquids into a cup or directly into a user's mouth, and as illustrated in FIG. 1, the neck 16 preferably extends upwardly from a substantially planar upper surface 21 of bottom portion 12 (surface 21 being the upper surface of outer container 13).

Where it is desirable to utilize the flask 10 with hot or cold liquids, and to maintain the temperature of the liquids over a period of time, heat insulating means may be provided between the inner and outer containers 13, 14. For instance, foam insulation 22 (see FIG. 1) may be provided therebetween, the volume may be evacuated, or the like.

The flask 10 further includes a top portion 24 which is adapted to mate with the bottom portion 12. Together, the top and bottom portions comprise the general exterior configuration of the flask 10, which exterior configuration preferably is in the form of a ball used in sporting events, such as a soccer ball (FIGS. 1 through 3), basketball (FIG. 4), tennis ball, baseball, football, or the like. Surface means are formed on the top and bottom portions for releasably holding the top portion 24 to the bottom portion 12 so that the neck 16 and cap 18 are covered by the top portion 24 and not visible from the exterior of the flask 10 with the top portion 24 in a position held by the bottom portion 12, and are visible from the exterior of the flask 10 when the top portion 24 is in a detached position (FIG. 1) not held by the bottom portion 12. The surface means may comprise any suitable structure, such as cooperating projections and depressions, or the like. In the embodiment illustrated in FIG. 1 of the drawings, the surface means comprise the upwardly extending surfaces 26 defining the upward planar surface 21 of bottom 12, and the interior lip 28 of the hollow top portion 24. An interference fit is provided between the surfaces 26, 28. In order to facilitate detachment of the top 24 from the bottom 12 once they are moved into position, one or more indentations 30 may be provided in the bottom portion 12 adjacent the surface means (26, 28) to allow an individual using the flask 10 to insert his/her finger underneath the top portion 24 to effect detachment.

The components forming the flask may be constructed of any suitable material, but preferably are made of a relatively hard plastic, but one which has suitable flexibility and resiliency to provide effective interengagement between the housing portions.

The flask 10 further comprises a cord, strap, string, or the like, such as the cord 32 illustrated in FIG. 1. The term "cord" as used in the present specification and claims is intended to encompass straps, strings, and like equivalent devices. Means are provided for attaching the cord to the bottom portion 12 adjacent the neck 16. Such attaching means may take the form of external manifestations formed on the bottom portion 12 outer container 13 (such as on planar surface 21), adhesive, or the like. In the embodiment illustrated in FIG. 1, the attaching means comprise means defining an opening 33 extending through the outer container 13 (top surface 21 thereof) receiving the cord therein, and means provided between the inner and outer containers for preventing passage of the cord portion between the containers 13, 14 through the opening 33. Such passage preventing means may comprise a knot formed on the end of the cord 32, a pin 34 attached to the cord end and dimensioned so that it cannot pass through opening 33, or the like.

In order to facilitate assembly of the flask 10, a separable plate may be provided which defines the planar surface 21 and surface means 26, which plate may be glued, welded, or otherwise attached to the rest of the outer container 13 of the flask 10 once the cord 32 has been properly positioned with respect to it. The cord 32 is dimensioned, and the cord attaching means (e.g., 33, 34) are constructed so that the cord 32 can hang around a user's neck and support the bottom portion 12 resting generally on the user's chest area, allowing ready detachment of the top 24 from the bottom 12 and subsequent removal of the cap 18 from neck 16 for ready utilization of the flask 10.

The flask 10 further comprises means defining at least one opening in the top portion 24 providing passage of the cord 32 from the bottom portion 12 through the top portion 24. This provides for the top portion 24 to be movable with respect to the bottom portion 12 while it slides with respect to the cord 32, with the cord 32 maintained in association with the at least one opening receiving it. This essentially prevents complete detachment of the top 24 from the bottom 12, so that the top 24 will not be mislaid.

In the embodiment illustrated in FIGS. 1 and 2, two openings 36 are provided in the top portion 24 through which the cord 32 extends, the openings 36 generally in alignment with a pair of spaced attaching structures (e.g., each pair comprising opening 33 and pin 34), one on either side of the neck 16.

Figure 3:
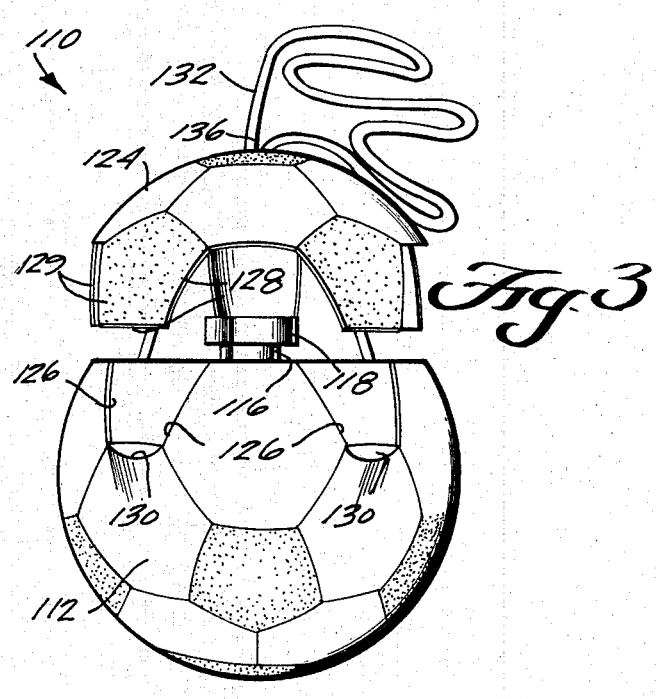
FIG. 3 is a side partially exploded view of a modification of the flask of FIG. 1.
Figure 4:
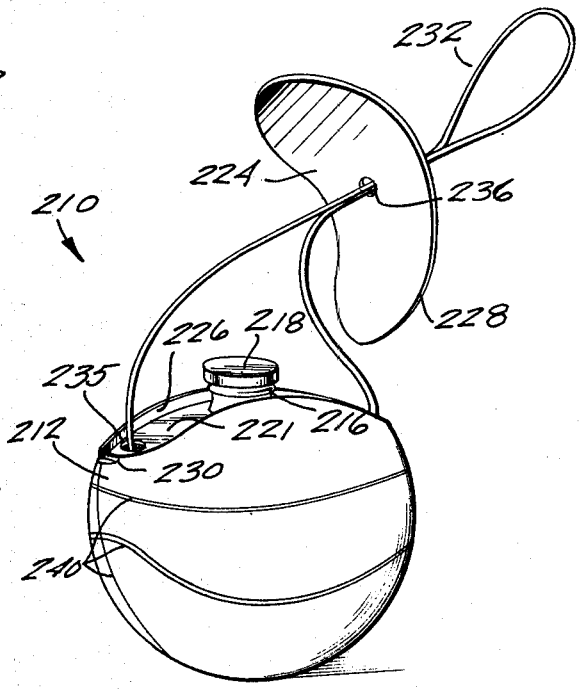
FIG. 4 is a perspective partially exploded view of another modification of a flask according to the present invention.

In the embodiment illustrated in FIG. 3, like components are identified by the same reference numeral as for the FIGS. 1 and 2 embodiment, except that they are preceded by a "1", while in FIG. 4 corresponding reference numerals are preceded by a "2".

In the FIG. 3 embodiment, the flask 110 has the same general configuration as the flask illustrated in FIGS. 1 and 2, except that the top portion 124 is constructed so that no exterior line of demarcation which would not appear on a real soccer ball is provided. This is accomplished by forming the top portion 124 so that it has outwardly extending fingers 129 corresponding to the colored pentagons of the soccer ball, and having edgges 128, which fit with edges 126 of cut-outs formed in the bottom portion 112. Also in this embodiment, a single opening 136 is defined in the top portion 124 through which the cord 132 extends.

In the embodiment illustrated in FIG. 4, the attaching means for the cord 232 to the bottom portion 212 comprise upstanding "eyelets" 235 formed on a top surface 221 of the bottom 212. The top portion 224 is provided as a segment between the seams 240 of the basketball configuration of the flask 210, again so that essentially no accessory line of demarcation is provided on the external configuration of the flask 210. In this embodiment, the surface means providing for attachment between the top 224 and bottom 212 comprise the peripheral edges 228 of the top 224, and the peripheral edges 226 of a cut-out in the external configuration of bottom 212 defining surface 221.

An exemplary flask or the like according to the present invention having been described, an exemplary manner of construction and manner of utilization thereof will now be set forth with respect to FIGS. 1 and 2:

The top portion 24 and the bottom outer container 13 (except for upper surface 21) are formed by injection molding, or the like, and an inner liquid container 14 having an integral neck 16 is constructed. Foam insulation 22 is placed on the interior lining of outer container 13, and inner container 14 is put in place adjacent foam 22. The ends of cord 32 are passed through openings 33 in a plate forming the surface 21, and the pins 34 are attached to the ends of the cord 32 on the opposite side of the plate forming surface 21 as the rest of the cord 32. The plate forming surface 21 is then disposed in mating relationship with the outer container 13 (the neck 16 passing through an opening formed in the plate), and ultrasonically welded in place.

The user fills the volume enclosed by the bottom portion 12 by pouring the desired beverage through the neck 16 with the cap 18 removed. Then the threads 19, 20 are brought into operative relationship, and the cap 18 screwed on the neck 16. The top portion 24 is then slid down the cord 32 until the surfaces 26, 28 mate. The flask 10 then has the exterior configuration of a soccer ball, the neck 16 and points of attachment of the cord 32 to the bottom portion 12 not being visible from the exterior.

The cord 32 is draped around the user's neck, with the bottom portion resting generally at the user's chest area. The user may then transport the flask 10 to a sporting event, or the like, and when it is desired to withdraw beverage from the flask 10 the user positions a finger in one or more indentations 30, and applies an upward force detaching the surface means 26, 28, allowing the top 24 to be slid away from the bottom portion 12 with respect to the cord 32. This may be accomplished while the cord 32 is still around the user's neck. The user then has access to the cap 18, unscrews the cap 18, and withdraws the beverage either by pouring it through neck 16 into a cup or directly into his/her mouth, or by inserting a straw through the open top of the neck 16. After the desired amount of beverage has been withdrawn, the cap 18 is screwed back in place, and the top portion 24 pushed downwardly to snap into covering engagement with the bottom portion 12. The beverage withdrawal may be repeated as desired.

It will thus be seen that according to the present invention a practical, versatile flask has been provided which may be constructed in many desirable realistic novelty configurations.

While the invention has been herein shown and described in what is presently conceived to be the most practical and preferred embodiment thereof, it will be apparent that many modifications may be made thereof within the scope of the invention, which scope is to be accorded the broadest interpretation of the appended claims so as to encompass all equivalent structures and devices.

What is claimed is:

1. A flask comprising: a bottom portion defining and enclosing a volume for containing liquid; a neck extending outwardly from said bottom portion and defining an open tubular passageway in liquid communication with the liquid-containing volume of said bottom portion; removable cap means for covering said neck to prevent passage of liquid through said tubular passageway; a top portion; surface means formed on said top and bottom portions for releasably holding said top portion to said bottom portion so that said neck and cap means are covered by said top portion and not visible from the exterior of the flask with said top portion in a position held by said bottom portion, and are visible from the exterior of the flask when said top portion is in a detached position, not held by said bottom portion; a cord; means for attaching said cord to said bottom portion adjacent said neck so that the areas of attachment of said cord to said bottom portion are not visible from the exterior of the flask when said top portion is in the position held by said bottom portion; means defining at least one opening in said top portion providing passage of said cord from said bottom portion through said top portion so that said top portion is movable with respect to said bottom portion and slides with respect to said cord, with said cord maintained in association with said at least one opening receiving said cord; and said cord being dimensioned and said cord attaching means being constructed so that said cord can hang around a human being's neck and support said bottom portion resting on the human being's chest area.

2. A flask as recited in claim 1 wherein said attaching means comprises a pair of spaced attaching structures, one on either side of said neck.

3. A flask as recited in claim 2 wherein said means defining at least one opening in said top portion comprises means defining a single central opening in said top portion intermediate said attaching structures when said top portion is in the position held by said bottom portion.

4. A flask as recited in claim 2 wherein said means defining at least one opening in said top portion comprises means defining a pair of openings in said top portion, said cord passing through both said openings.

5. A flask as recited in claim 1 wherein said neck is externally screw threaded, and wherein said cap means comprises a cap having internal threads corresponding to the external threading of said neck.

6. A flask as recited in claim 1 further comprising an indentation formed in the exterior surface of said bottom portion adjacent said surface means formed on said bottom portion so that an individual using the flask may insert his/her finger underneath said top portion to effect detachment of said top and bottom portions.

7. A flask as recited in claim 1 wherein said bottom portion comprises an outer container and an inner container, said neck integral with said inner container and extending outwardly through said outer container to upstand therefrom.

8. A flask as recited in claim 7 wherein heat insulating means are provided between said inner and outer containers.

9. A flask as recited in claim 7 wherein said attaching means comprise means defining an opening extending through said outer container receiving said cord therein, and means provided between said inner and outer containers for preventing passage of a cord portion between said inner and outer containers through said opening in said outer container.

10. A flask as recited in claim 1 wherein said top and bottom portions together comprise the general configuration of a ball used in sporting events.

11. A flask as recited in claim 1 having the general exterior configuration of a soccer ball, and wherein said surface means comprise a plurality of fingers extending outwardly from said top portion and having the general configuration of pentagons, and cooperating with cutouts formed in the exterior surface of said bottom portion, and wherein no accessory lines of demarcation between said top and bottom portions are provided on the exterior of the flask.

* * * * *